US009623655B2

(12) United States Patent
Uyama et al.

(10) Patent No.: US 9,623,655 B2
(45) Date of Patent: Apr. 18, 2017

(54) LIQUID DISCHARGE HEAD AND METHOD FOR MANUFACTURING THE SAME

(71) Applicant: CANON KABUSHIKI KAISHA, Tokyo (JP)

(72) Inventors: Masaya Uyama, Kawasaki (JP); Makoto Sakurai, Kawasaki (JP); Makoto Terui, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/954,750

(22) Filed: Nov. 30, 2015

(65) Prior Publication Data

US 2016/0152027 A1 Jun. 2, 2016

(30) Foreign Application Priority Data

Dec. 2, 2014 (JP) ..... 2014-244166

(51) Int. Cl.
*B41J 2/14* (2006.01)
*B41J 2/16* (2006.01)

(52) U.S. Cl.
CPC ..... *B41J 2/14088* (2013.01); *B41J 2/1404* (2013.01); *B41J 2/14016* (2013.01); *B41J 2/14129* (2013.01); *B41J 2/1603* (2013.01); *B41J 2/1628* (2013.01); *B41J 2/1629* (2013.01); *B41J 2/1631* (2013.01); *B41J 2/1642* (2013.01); *B41J 2/1646* (2013.01); *B41J 2202/11* (2013.01); *B41J 2202/13* (2013.01)

(58) Field of Classification Search
CPC .. B41J 2/14032; B41J 2/14016; B41J 2/1404; B41J 2/14088; B41J 2202/11
See application file for complete search history.

(56) References Cited

U.S. PATENT DOCUMENTS 6,513,896 B1 * 2/2003 Kawamura ..... B41J 2/1404 347/15
8,771,792 B2 * 7/2014 Asai ..... B41J 2/1631 29/890.09
2012/0047737 A1 * 3/2012 Ishida ..... B41J 2/1404 29/890.1

FOREIGN PATENT DOCUMENTS

JP 2003311964 A 11/2003
JP 2007216415 A 8/2007

* cited by examiner

*Primary Examiner* — Geoffrey Mruk
(74) *Attorney, Agent, or Firm* — Canon U.S.A. Inc., IP Division

(57) ABSTRACT

A method for manufacturing a liquid discharge head that includes a discharge-port-forming member, which has discharge ports through which a liquid is discharged, and a pressure-chamber-forming member, which includes pressure chambers communicating with the discharge ports and each including a heating resistor formed in a bottom portion thereof and which has a surface joined to the discharge-port-forming member, includes preparing the pressure-chamber-forming member in which wiring layers each including a barrier metal as a base member are formed, forming the pressure chambers, whose depths from the surface are different from each other and which include the heating resistors each formed of one of the barrier metals, by recessing the pressure-chamber-forming member from the surface and removing at least two of the wiring layers, which are formed at different positions in a depth direction from the surface, to expose the corresponding barrier metals, and forming the discharge-port-forming member on the surface.

7 Claims, 5 Drawing Sheets

LIQUID DISCHARGE HEAD AND METHOD FOR MANUFACTURING THE SAME

BACKGROUND OF THE INVENTION

Field of the Invention

The present invention relates to a liquid discharge head that discharges a liquid droplet and a method for manufacturing the liquid discharge head.

Description of the Related Art

As an example of a configuration of a liquid discharge head, a configuration disclosed in Japanese Patent Laid-Open No. 2003-311964 (hereinafter referred to as Patent Document 1) in which at least two or more discharge portions, each of which is capable of discharging a liquid droplet having a size different from that of the liquid droplet discharged by the other discharge portion, are disposed in one chip is known. With this configuration, a liquid discharge head that is capable of discharging liquid droplets having a plurality of sizes from a single chip by changing the substantial volume of a liquid, which is applied with pressure generated when part of the liquid bubbles, may be obtained. In particular, in the invention disclosed in Patent Document 1, the diameters of discharge ports that are formed in a chip for discharging a liquid, the areas of heating resistors that cause the liquid to bubble, and the planar sizes of pressure chambers in which the heating resistors are formed are varied.

Japanese Patent Laid-Open No. 2007-216415 (hereinafter referred to as Patent Document 2) discloses a liquid discharge head capable of discharging liquid droplets having a plurality of sizes from a single chip by varying the sizes of pressure chambers in a height direction by varying the thicknesses of portions of a discharge-port-forming member in which discharge ports are formed, that is, the heights of the portions of the discharge-port-forming member from a surface in which heating resistors are installed to the discharge ports.

In the case of the liquid discharge head disclosed in Patent Document 1, in order to vary the sizes of liquid droplets to be discharged, it is primarily necessary to vary the planar sizes of the pressure chambers so as to vary the volumes of the pressure chambers. Thus, in order to discharge a large liquid droplet, a pressure chamber having an area large enough to discharge the large liquid droplet needs to be formed, and the liquid discharge head has a limitation with regard to densely arranging a plurality of discharge ports.

On the other hand, the liquid discharge head disclosed in Patent Document 2 is advantageous for the dense arrangement of discharge ports since the sizes of the pressure chambers are varied in the height direction. However, in the invention disclosed in Patent Document 2, a surface of the discharge-port-forming member in which the discharge ports are formed (hereinafter referred to as a discharge-port surface) has differences in level. In the field of inkjet recording heads, in general, in order to remove a liquid adhering to a discharge-port surface and to prevent a discharge abnormality from occurring or recover from the discharge abnormality, wiping of the discharge-port surface is performed. Thus, in the case where the discharge-port surface has a difference in level, there have been problems in that it is difficult to properly wipe the discharge ports positioned at a lower level, and that it is difficult to ensure reliability against long-term use.

Accordingly, in view of the above-mentioned problems in the related art, the present invention is directed to a configuration of a liquid discharge head that is capable of having a dense arrangement of discharge ports and efficiently performing wiping of a discharge-port surface.

SUMMARY OF THE INVENTION

The present invention provides a method for manufacturing a liquid discharge head that includes a discharge-port-forming member having discharge ports through which a liquid is to be discharged and a pressure-chamber-forming member including a plurality of pressure chambers, each of which is in communication with a corresponding one of the discharge ports and each of which includes a heating resistor formed in a bottom portion of the pressure chamber, and having a surface joined to the discharge-port-forming member, the method including preparing the pressure-chamber-forming member in which a plurality of wiring layers, each of which includes a barrier metal as a base member, are formed, forming the plurality of pressure chambers that include the heating resistors, each of which is formed of one of the barrier metals, and whose depths from the surface are different from each other by recessing the pressure-chamber-forming member from the surface and removing the plurality of wiring layers that are formed at different positions in a depth direction from the surface to expose the corresponding barrier metals, and forming the discharge-port-forming member on the surface.

According to the present invention, in the pressure-chamber-forming member having a joint surface, which is joined to the discharge-port-forming member, the volumes of the plurality of pressure chambers can be varied without changing the planar size of the pressure-chamber-forming member by forming the pressure chambers by arbitrarily changing the recess depths from the joint surface. As a result, a dense arrangement of the discharge ports, each of which is in communication with the corresponding pressure chamber, can be easily realized, and liquid droplets of a plurality of sizes can be discharged in the same pressure-chamber-forming member.

Since the pressure chambers whose depths from the joint surface of the pressure-chamber-forming member, which is joined to the discharge-port-forming member, are different from each other are formed, a front surface (discharge-port surface) of the discharge-port-forming member that is formed on the joint surface is also flat surface. Thus, an operation of wiping the discharge-port surface to which the liquid has adhered can be efficiently performed, and the reliability against long-term use can be ensured.

According to the present invention, a liquid discharge head in which the dense arrangement of discharge ports can be realized and in which the discharge-port surface can be efficiently wiped can be provided.

Further features of the present invention will become apparent from the following description of exemplary embodiments with reference to the attached drawings.

DESCRIPTION OF THE EMBODIMENTS

Embodiments of the present invention will be described below with reference to the drawings. However, the embodiments, which will be described below, do not limit the present invention and are given to fully explain the present invention to a person having an ordinary skill in the art.

First Embodiment

Figure 1:
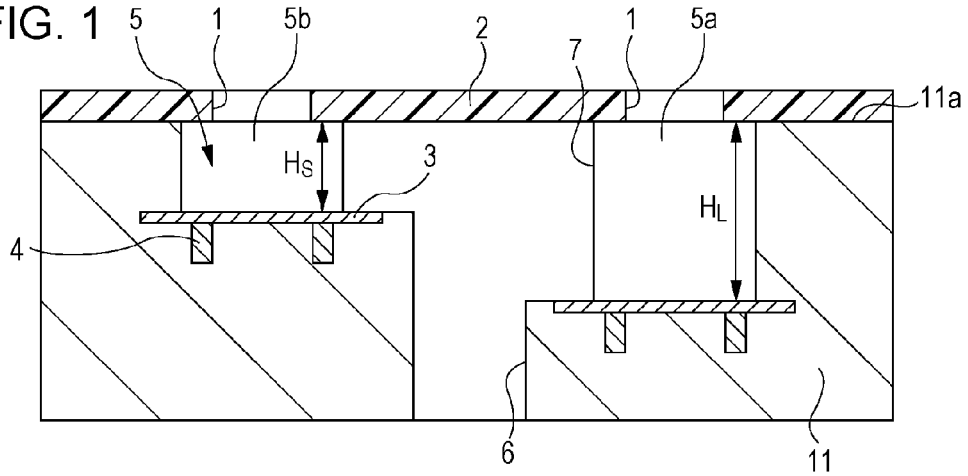
FIG. 1 is a sectional view illustrating a configuration of a liquid discharge head according to a first embodiment.
Figure 2:
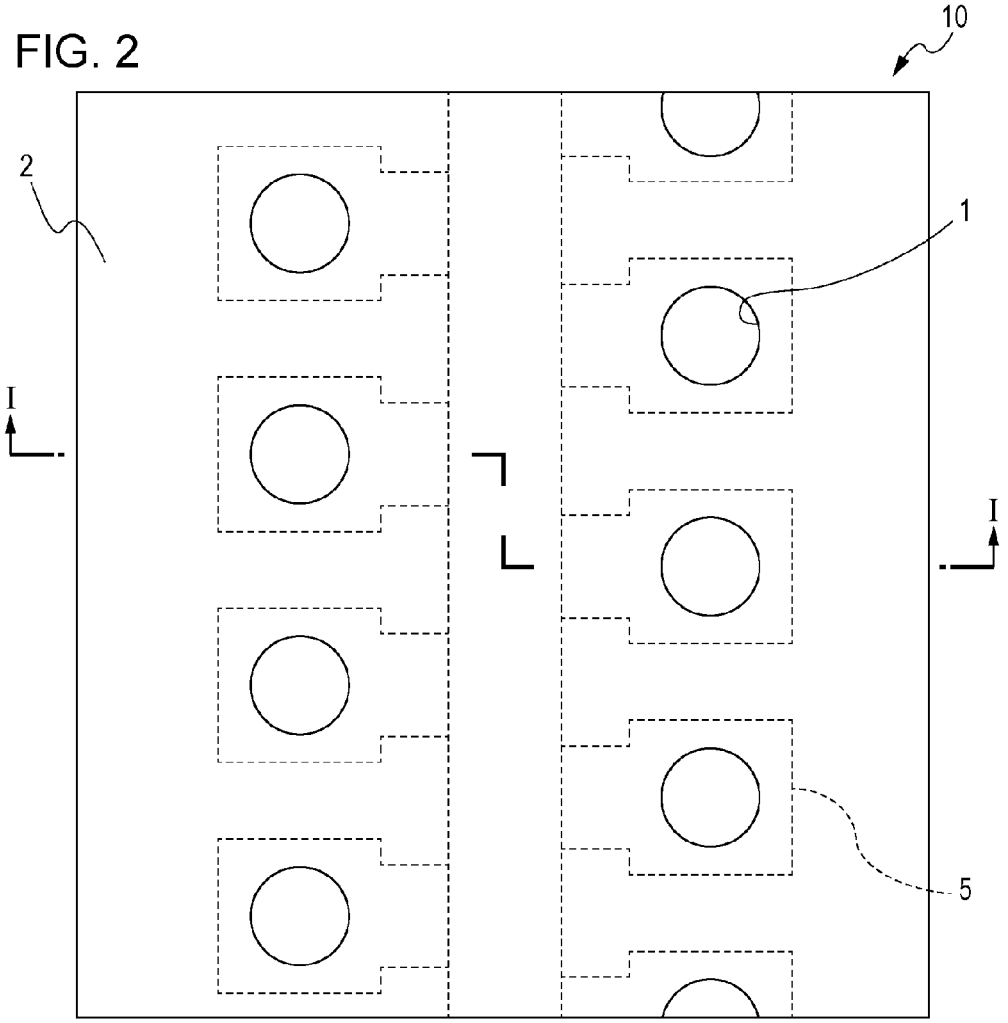
FIG. 2 is a top view of the liquid discharge head according to the first embodiment.

FIG. 2 is a plan view of a liquid discharge head 10 according to a first embodiment. A plurality of discharge ports 1 are formed in a discharge-port-forming member 2. A plurality of pressure chambers 5 are formed so as to be positioned further toward the back side as viewed in FIG. 2 than the discharge-port-forming member 2 in such a manner as to correspond to the discharge ports 1. FIG. 1 is a sectional view taken along line I-I of FIG. 2.

As illustrated in FIG. 1 and FIG. 2, the liquid discharge head 10 includes the discharge-port-forming member 2 that has the discharge ports 1 through which a liquid, such as an ink, is to be discharged and a substrate 11 that has a joint surface 11*a*, which is joined to the discharge-port-forming member 2. The discharge-port-forming member 2 is formed as a plate having a fixed thickness. In the first embodiment, the substrate 11 is a pressure-chamber-forming member, and the pressure chambers 5 (5*a* and 5*b*) each of which is in communication with the corresponding discharge port 1 are formed by recessing the substrate 11 from the joint surface 11*a*, which is joined to the discharge-port-forming member 2. A pressure-generating element 3, such as a heating resistor that applies pressure to the liquid, is formed in a bottom portion of each of the pressure chambers 5, the bottom portion facing the discharge-port-forming member 2. Electrodes 4 for supplying power to the pressure-generating elements 3 are connected to the pressure-generating elements 3. In the first embodiment, the electrodes 4 extend in a direction toward a surface of the substrate 11 that is opposite to the joint surface 11*a*. Liquid-flow paths 7 and liquid-supply paths 6 through which the liquid is to be supplied to the pressure chambers 5 are formed in the substrate 11.

In the liquid discharge head 10, which has the above-described configuration, the depths of the plurality of pressure chambers 5*a* and 5*b* from the joint surface 11*a* of the substrate 11, which is joined to the discharge-port-forming member 2, are different from each other. In the first embodiment, in the pressure chambers 5, the distances from the joint surface 11*a* to the corresponding pressure-generating elements 3, which are disposed so as to face the discharge-port-forming member 2, (the heights of the pressure chambers 5 in a direction perpendicular to surfaces of the pressure chambers 5, in which the corresponding pressure-generating element 3 are formed) are different from each other. In FIG. 1, these distances (heights) are denoted by the reference numerals $H_L$ and $H_S$, and the liquid discharge head 10 of the first embodiment satisfies a relationship of $H_L > H_S$. Accordingly, the volumes of the pressure chambers 5 are varied, so that a large liquid droplet can be ejected from the pressure chamber 5*a* having the height $H_L$, and a small liquid droplet can be ejected from the pressure chamber 5*b* having the height $H_S$. For example, when trying to obtain a large liquid droplet of 5 pl and a small liquid droplet of 2 pl, the value of $H_L$ and the value of $H_S$ can respectively be selected from the values in a range of 5 μm to 50 μm and the values in a range of 3 μm to 20 μm although they depend on the sizes of the discharge ports 1 and the input energy that is to be applied to the pressure-generating elements 3, which are heating resistors.

The pressure chambers 5 are formed by recessing a flat top surface of the substrate 11, which is the joint surface 11*a* joined to the discharge-port-forming member 2, in a thickness direction of the substrate 11. Thus, even in the case where the heights (recess depth) of the pressure chambers 5 are set to be different from each other, the top surface of the substrate 11 can be maintained in a flat state, and consequently, a front surface (discharge-port surface) of the discharge-port-forming member 2, which is formed on the top surface, is also a flat surface. Therefore, in the case of wiping a very small amount of the liquid that adhere to the discharge-port surface when the liquid discharge head 10 is used, an effective wiping operation can be ensured since the discharge-port surface does not have a difference in level.

Second Embodiment

Figure 3:
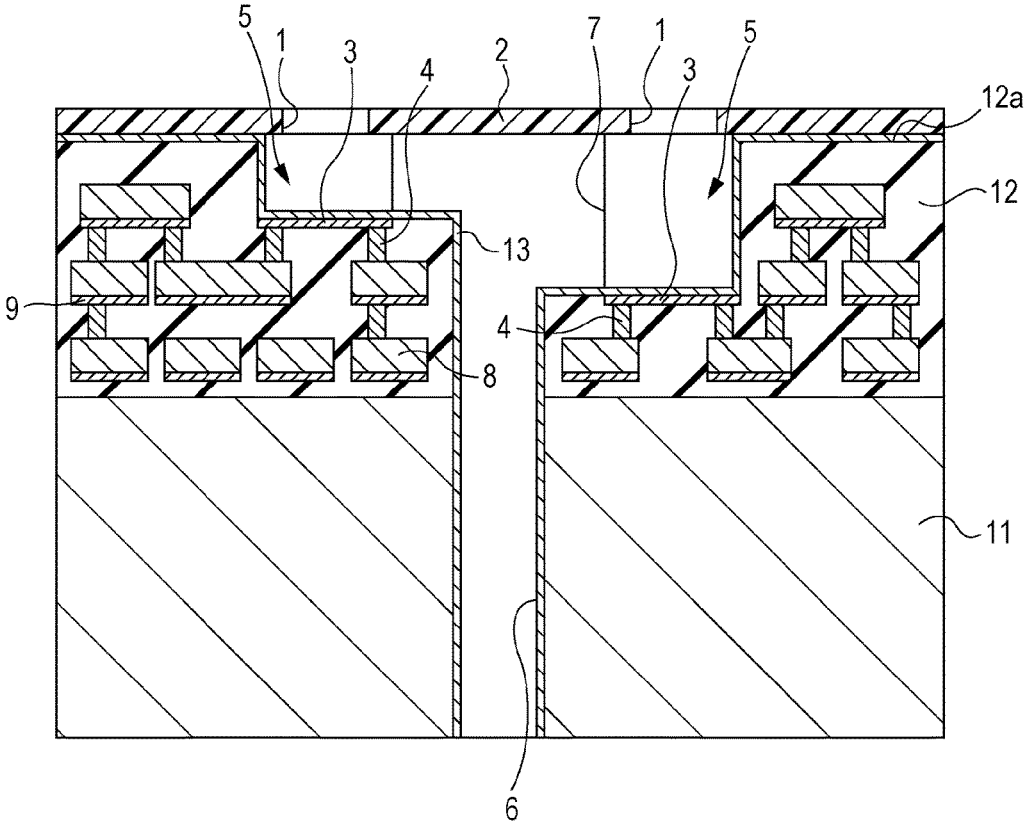
FIG. 3 is a sectional view illustrating a configuration of a liquid discharge head according to a second embodiment.

FIG. 3 is an enlarged sectional view taken along line I-I of FIG. 2 and is a diagram illustrating a liquid discharge head according to a second embodiment that includes a plurality of wiring layers 8 connected to the electrodes 4.

In the second embodiment, the differences from the first embodiment are that a pressure-chamber-forming member is an insulating film 12 that is formed on the substrate 11, and that the plurality of pressure chambers 5 are formed by recessing a flat top surface of the insulating film 12, which is a joint surface 12*a* joined to the discharge-port-forming member 2, in a film-thickness direction. Referring to FIG. 3, the plurality of wiring layers 8 are formed in such a manner as to be included in the insulating film 12 is formed on the substrate 11 that is formed of a silicon substrate. The plurality of wiring layers 8 are formed at different positions in a depth direction of the pressure chambers 5, which is a direction from the joint surface 12*a* toward the pressure-generating elements 3. In addition, in order to prevent a metal material of the wiring layers 8 from diffusing into the insulating film 12, a barrier metal 9 is formed on a lower surface of each of the wiring layers 8. In the second embodiment, the areas of some of the barrier metals 9 after removing the corresponding wiring layers 8 each serve as a resistor, and the resistor generates heat when a current flows therethrough so as to serve as the pressure-generating element 3. The electrodes 4, which are connected to the pressure-generating elements 3, and the wiring layers 8 are ultimately connected to a driver (not illustrated) that performs a switching operation for starting and stopping application of a voltage to the pressure-generating elements 3.

The material of the barrier metals 9 is selected in accordance with barrier characteristics of the barrier metals 9 and the stability of resistance of the barrier metals 9 changes as a result of generating heat, and for example, one of TaSiN and WSiN or both TaSiN and WSiN can be selected as the material of the barrier metals 9.

In order to discharge liquid droplets having different sizes from the pressure chambers 5 having different heights, it is necessary to optimize bubble-generating energy required for ejecting the liquid in accordance with each liquid droplet amount. In the case where the voltage that is to be applied to the heating resistors, which serve as the pressure-generating elements 3, is constant, it is necessary to adjust the sheet resistances of the heating resistors by varying the planar areas of the heating resistors in order to obtain the bubble-generating energy required for each liquid droplet amount. In order to cause a large liquid droplet to bubble, one of the heating resistors used for causing the large liquid droplet to bubble needs to have a large area. However, according to the present invention, some of the barrier metals 9, which form the heating resistors, are formed in layers at different levels due to the difference between the heights of the pressure chambers 5. Thus, even if each of the heating resistors has the same planar area, each of the sheet resistances can be set to be an optimum resistance by adjusting the film thicknesses of the barrier metals 9 and the specific resistances of the films. Therefore, even in the case where one of the pressure chambers 5 is formed in order to discharge a large liquid droplet, an increase in the planar area of the corresponding heating resistor can be suppressed. In addition, the integration degree of the liquid discharge head 10 can be increased, so that the number of liquid discharge heads 10 per wafer can be increased. As a result, the manufacturing costs can be reduced.

Note that the resistances of the barrier metals 9 that form the heating resistors provided in the pressure chambers 5, which have different depths in order to discharge liquid droplets of different sizes, may be set as follows. The resistance of one of the barrier metals 9 that is provided in one of the pressure chambers 5 that discharges a relatively large amount of liquid droplets may be set to be relatively small, and the resistance of one of the barrier metals 9 that is provided in one of the pressure chambers 5 that discharges a relatively small amount of liquid droplets may be set to be relatively large.

In addition, the liquid discharge head 10 includes the plurality of wiring layers 8, and wiring lines that apply a voltage to the heating resistors are arranged in a plurality of layers so that the liquid discharge head 10 has a multilayer wiring structure. Thus, the manufacturing costs can be further reduced by increasing the integration degree of each of the heating resistors and each of the discharge ports 1 with respect to the substrate 11.

A passivation film 13 for suppressing corrosion of the material of the heating resistors caused by the liquid to be ejected may be formed over the front surfaces (surfaces facing the interior of the pressure chambers 5) of the heating resistors, which serve as the pressure-generating elements 3.

As illustrated in FIG. 3, the passivation film 13 may be formed in such a manner as to protect the inner walls of the pressure chambers 5. In addition, the passivation film 13 can be formed in such a manner as to also extend over wall surfaces of the liquid-supply paths 6 and the liquid-flow paths 7. By forming the passivation film 13 in this manner, the probability of the components of the liquid discharge head 10, such as the inner walls of the pressure chambers 5 and the heating resistors, becoming corroded due to the liquid can be reduced, and the long-term reliability of the liquid discharge head 10 can be ensured.

The material of the passivation film 13 can be selected from metal elements, such as Si, Ti, and Ta, and a compound containing at least one of O, N, and C. Alternatively, the material of the passivation film 13 may be selected from SiCN, SiCO, TaO, and TiO.

Figure 4:
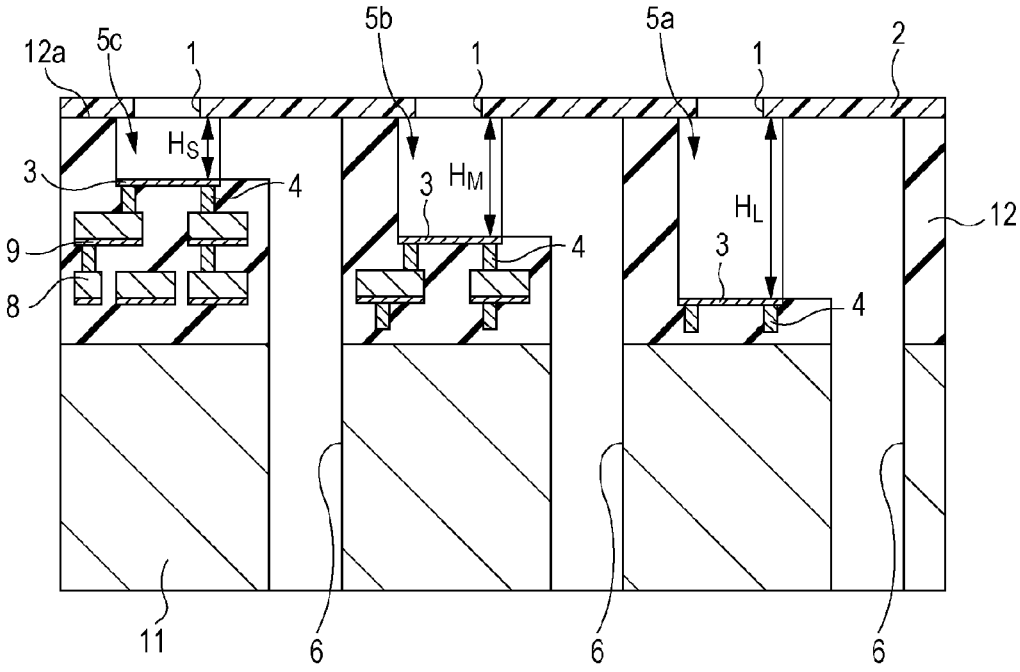
FIG. 4 is a sectional view illustrating a modification of the configuration of the liquid discharge head according to the second embodiment.

FIG. 4 is a diagram illustrating a sectional configuration of the liquid discharge head 10 in the case where there are three different heights of the pressure chambers 5. When the sizes of the liquid droplets to be ejected are referred to as large, medium, and small, the pressure chamber 5*a* having a height $H_L$, the pressure chamber 5*b* having a height $H_M$, and a pressure chamber 5*c* having a height $H_S$ are formed.

There may be three or more different heights of the pressure chambers 5. The volume of each of the pressure chambers 5 varies in accordance with its height, and liquid droplets having a size corresponding to the volume of each of the pressure chambers 5 can be obtained.

Third Embodiment

FIGS. 5A to 5E are sectional views illustrating steps of a method for manufacturing the liquid discharge head 10 according to the present invention. Although FIGS. 5A to 5E illustrate the method for manufacturing the liquid discharge head 10 that has the configuration illustrated in FIG. 3, the present invention can also be applied to the configurations illustrated in FIG. 1 and FIG. 4. Each step of the manufacturing method will be described in detail below.

Figure 5A:
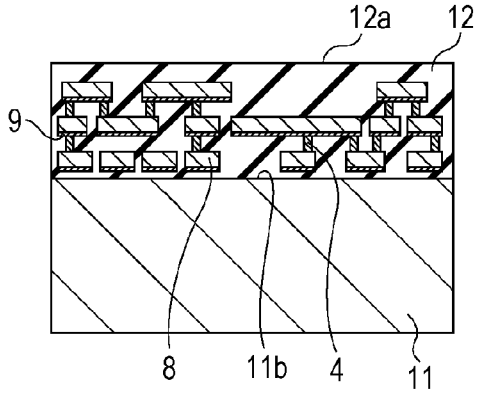
FIGS. 5A to 5E are sectional views illustrating steps of a method for manufacturing a liquid discharge head according to a third embodiment.

The step illustrated in FIG. 5A is a step of preparing the substrate 11 that has a main surface 11*b* on which the insulating film 12 is formed. The plurality of wiring layers 8 and barrier metals 9 are included in the insulating film 12. From the standpoint of processability and productivity, a silicon oxide film may be used as the insulating film 12 and can be deposited by plasma enhanced chemical vapor deposition (PECVD). A material, such as Al, AlCu, AlSi, and AlSiCu, can be used as a wiring metal that forms each of the wiring layers 8, and a material, such as TaSiN and WSiN, can be used as the material of the barrier metals 9, which are base members of the wiring layers 8. Film deposition by sputtering may be used as the method for forming the wiring layers 8 and the barrier metals 9. The plurality of wiring layers 8 are electrically connected to one another via the electrodes 4. As the material of the electrodes 4, tungsten (W) may be used, and PECVD can be used as a film deposition method. Regarding the wiring layers 8, the barrier metals 9, and the electrodes 4, by using film deposition, photolithography, etching, chemical mechanical polishing (CMP), or the like, which is a common semiconductor manufacturing process, a desired material can be efficiently formed at a desired position on a wafer. Note that some of the barrier metals 9 are used as the heating resistors. Accordingly, as described in the above embodiments, the barrier metals 9 that are disposed as the base members of the plurality of the wiring layers 8, which are formed at different positions in the depth direction, may be formed so as to have an optimum film thickness and an optimum specific resistance.

Figure 5D:
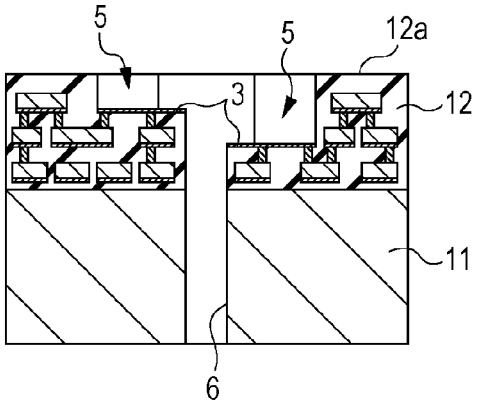
Figure 5B:
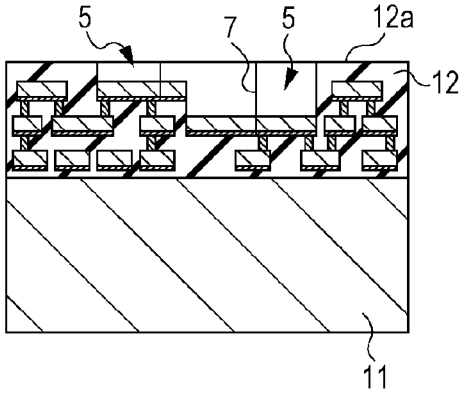
Figure 5E:
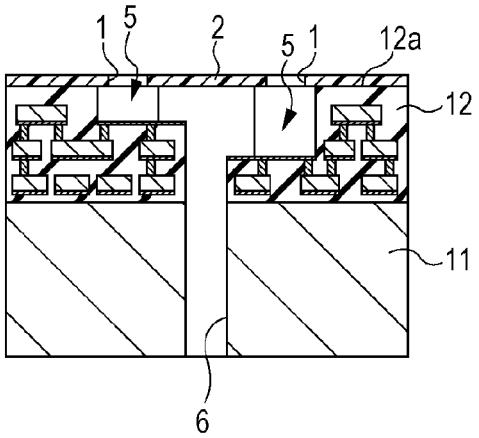

The step illustrated in FIG. 5B is a step of removing portions of the insulating film 12 so as to form the pressure chambers 5 and the liquid-flow paths 7. The portions of the insulating film 12 can be efficiently removed by reactive ion etching (RIE) using a positive resist as a mask member (not illustrated). In order to form the pressure chambers 5 having different depths, it may be considered to sequentially form mask members in accordance with the depths of the pressure chambers 5 and perform dry etching. However, the following method may be used. That is to say, by using some of the wiring layers 8 as etching-stop layers, a sufficient selection ratio of etching between the insulating film 12 and the etching-stop layers can be obtained, and the pressure chambers 5 having a plurality of depths can be formed at the same time, which in turn results in a good productivity. The portions of the insulating film 12 are removed, and some of the wiring layers 8 are exposed through the above steps. The insulating film 12 is formed on the main surface 11*b* of the substrate 11, and the step of removing the portions of the insulating film 12 may be performed from a front surface of the insulating film 12, the front surface being opposite to a surface of the insulating film 12 that faces the main surface 11*b* of the substrate 11.

Figure 5C:
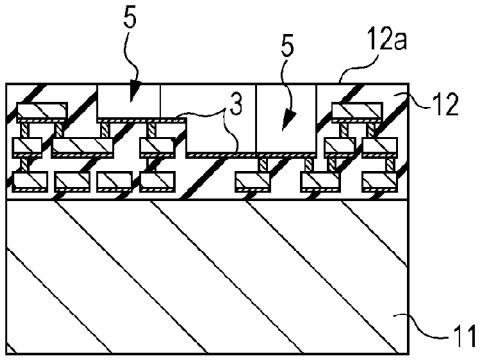

The step illustrated in FIG. 5C is a step of forming the heating resistors, which serve as the pressure-generating element 3, by etching some of the wiring layers 8 in such a manner as to expose the corresponding barrier metals 9. Although it depends on the materials of the wiring layers 8 and the barrier metals 9, in the case where the metal of the wiring layers 8 is selected from Al, AlCu, AlSi, and AlSiCu, and the barrier metals 9 are made of TaSiN or WSiN, the wiring layers 8 can be selectively removed by wet etching without damaging the barrier metals 9. As a liquid used in the wet etching, a versatile mixed acid of phosphoric acid, nitric acid, and acetic acid for semiconductor use can be used.

The step illustrated in FIG. 5D is a step of forming the liquid-supply paths 6, which are used for supplying the liquid to the pressure chambers 5 through the liquid-flow paths 7, in the substrate 11. In the case where the substrate 11 is made of silicon (Si), each of the liquid-supply paths 6 can be formed by forming a mask member (not illustrated) at a desired position on the rear surface of the substrate 11 and efficiently removing Si by a method that is commonly referred to as Bosch process. Alternatively, the liquid-supply paths 6 can be formed by crystal anisotropic etching using an alkaline solution. In both of the methods, the etching operation stops at the insulating film 12. After that, portions of the insulating film 12 and the barrier metals 9 are removed by performing RIE using a fluorocarbon gas on the rear surface of the substrate 11, and as a result, the liquid-supply paths 6 extend through the substrate 11.

Figure 6:
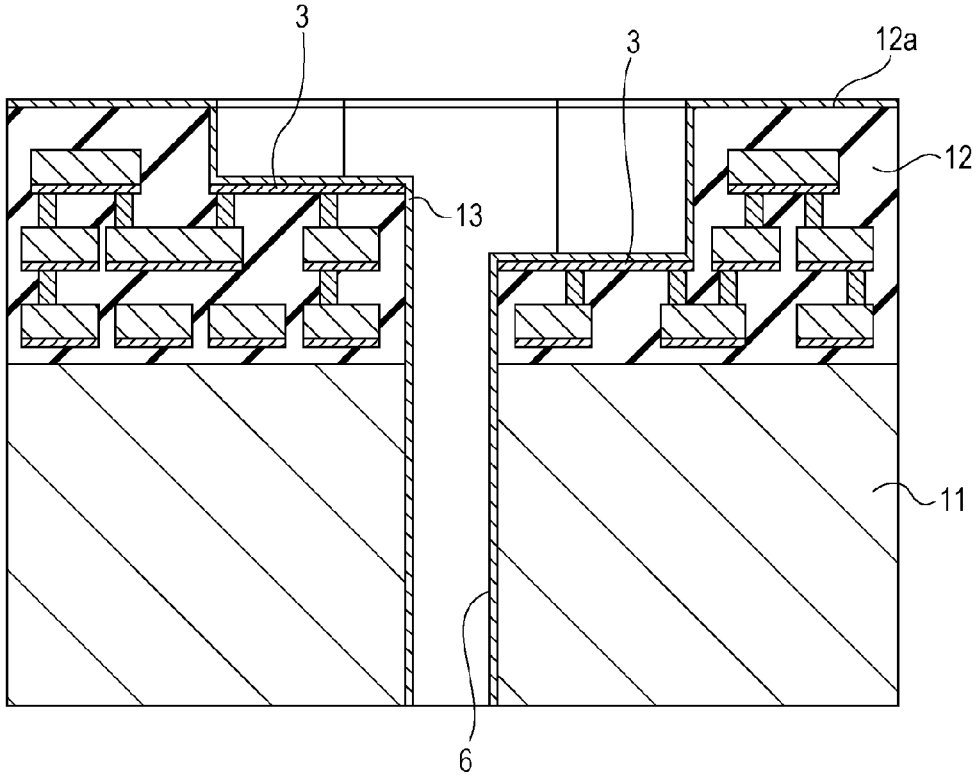
FIG. 6 is a sectional view illustrating a modification of part of the manufacturing method illustrated in FIGS. 5A to 5E.

Note that, after the step illustrated in FIG. 5D, the passivation film 13, which is a corrosion-resistant film, may be formed over the front surfaces of the pressure-generating elements 3 and the wall surfaces of the pressure chambers 5, the liquid-supply paths 6, and the liquid-flow paths 7 as illustrated in FIG. 6. Although it depends on the type of the passivation film 13, the passivation film 13 can be deposited by PECVD or atomic layer deposition (ALD). In the case where the material of the passivation film 13 is a SiCN film, the passivation film 13 can be formed by PECVD using gas, such as $SiH_4$, $NH_3$, or $CH_4$, and in the case where the material of the passivation film 13 is a SiCO film, the passivation film 13 can be formed by PECVD using gas, such as $SiH_4$, $CH_4$, or $O_2$. In the case where the material of the passivation film 13 is TaO or TiO, the passivation film 13 can be formed by ALD.

Returning to FIGS. 5A to 5E, the step illustrated in FIG. 5E is a step of forming the discharge-port-forming member 2, in which the discharge ports 1 are formed, so as to be flat on the front surface (joint surface 12*a*) of the insulating film 12. The discharge-port-forming member 2, which is flat, can be formed by laminating a resin in the form of a dry film (dry film resist). A negative photosensitive epoxy resin may be used as the material of the discharge-port-forming member 2. Since the epoxy resin has photosensitivity, the discharge ports 1 can be efficiently formed by performing exposure and development on part of the epoxy resin forming certain portions of the discharge-port-forming member 2 that correspond to the pressure chambers 5.

The liquid discharge head 10 that is formed by the above manufacturing method is capable of discharging liquid droplets of a plurality of sizes from the same head. In addition, since the front surface (discharge-port surface) of the discharge-port-forming member 2 is flat, a maintenance operation, such as wiping for removing the liquid adhering to the discharge-port surface, can be efficiently performed, and reliability against long-term use can be improved.

Note that, although some embodiments of the present invention have been described above, the present invention is not limited to the above embodiments, and suitable modifications may be made to the configurations and the shapes within the technical concept of the present invention. In addition, the liquid discharge head according to the present invention can be applied to an inkjet printer that records an image onto a medium to be recorded on. However, the present invention is not limited to the field of printers and can be applied to apparatuses in general that perform some processing on an object by discharging a liquid onto the object.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-244166, filed Dec. 2, 2014, which is hereby incorporated by reference herein in its entirety.

What is claimed is:

1. A liquid discharge head comprising:

a discharge-port-forming member having a first discharge port and a second discharge port through which a liquid is to be discharged, the first discharge port and the second discharge port being formed in a same surface of the discharge-port-forming member; and a pressure-chamber-forming member that includes a first pressure chamber which is in communication with the first discharge port and includes a first heating resistor formed in a bottom portion of the first pressure chamber, a second pressure chamber which is in communication with the second discharge port and includes a second heating resistor formed in a bottom portion of the second pressure chamber, a plurality of wiring layers, each of which includes a barrier metal as a base member, and a joint surface, which is joined to the discharge-port-forming member, wherein the first heating resistor and the second heating resistor whose depths from the same surface of the discharge-port-forming member are different from each other, the first heating resistor is formed of a first barrier metal, the second heating resistor is formed of a second barrier metal, and the plurality of wiring layers is not provided on a surface at a side of the joint surface of the first barrier metal and the second barrier metal.

2. The liquid discharge head according to claim 1, wherein resistance values of the first barrier metal and the second barrier metal are different from each other in accordance with the corresponding the first pressure chamber and the second pressure chamber, which have different depths.

3. The liquid discharge head according to claim 1, wherein the joint surface is formed of a flat surface.

4. The liquid discharge head according to claim 1, wherein each of the first heating resistor and the second heating resistor is connected to an electrode extending in a direction toward a surface of the pressure-chamber-forming member that is opposite to the joint surface.

5. The liquid discharge head according to claim 1, wherein the first heating resistor and the second heating resistor are electrically connected to the plurality of wiring layers.

6. The liquid discharge head according to claim 5, wherein the wiring layers are provided at different positions in a direction orthogonal to the joint surface.

7. The liquid discharge head according to claim 1, wherein the plurality of wiring layers are formed to be included in an insulating film and the barrier metal is formed on a lower surface of each of the wiring layers to prevent metal material of the wiring layers from diffusing into the insulating film.

* * * * *